US010036191B2

(12) United States Patent
Katsuyama et al.

(10) Patent No.: US 10,036,191 B2
(45) Date of Patent: Jul. 31, 2018

(54) VEHICLE DOOR OPENING/CLOSING APPARATUS

(71) Applicant: AISIN SEIKI KABUSHIKI KAISHA, Kariya-shi (JP)

(72) Inventors: Hiroki Katsuyama, Nagoya (JP); Kimihide Kato, Nisshin (JP); Koji Oe, Kariya (JP); Takayuki Sengoku, Chiryu (JP); Keisuke Haruta, Obu (JP); Jun Tsukagoshi, Obu (JP)

(73) Assignee: AISIN SEIKI KABUSHIKI KAISHA, Kariya-shi (JP)

( * ) Notice: Subject to any disclaimer, the term of this patent is extended or adjusted under 35 U.S.C. 154(b) by 0 days.

(21) Appl. No.: 15/269,415

(22) Filed: Sep. 19, 2016

(65) Prior Publication Data

US 2017/0089113 A1 Mar. 30, 2017

(30) Foreign Application Priority Data

Sep. 30, 2015 (JP) ..... 2015-194033

(51) Int. Cl.
*E05F 15/622* (2015.01)
*E05F 15/00* (2015.01)

(52) U.S. Cl.
CPC ..... *E05F 15/622* (2015.01); *E05F 15/00* (2013.01); *E05Y 2201/702* (2013.01); *E05Y 2600/60* (2013.01); *E05Y 2900/546* (2013.01)

(58) Field of Classification Search
CPC .. E05F 15/622; E05F 15/00; E05Y 2900/546; F16H 25/20; F16H 2025/2075; Y10T 74/18576
See application file for complete search history.

(56) References Cited

U.S. PATENT DOCUMENTS 8,375,814 B2 * 2/2013 Hillen ..... F16D 7/044 192/55.1
8,601,891 B2 * 12/2013 Bochen ..... F16H 25/2015 74/89.37
9,605,735 B2 * 3/2017 Missler ..... F16H 25/20
2009/0206826 A1 * 8/2009 Booth ..... E05F 15/00 324/207.2

(Continued)

FOREIGN PATENT DOCUMENTS

JP 2014-100956 6/2014
WO WO2014135646 * 9/2014

*Primary Examiner* — Justin B Rephann

(74) *Attorney, Agent, or Firm* — Oblon, McClelland, Maier & Neustadt, L.L.P.

(57) ABSTRACT

A vehicle door opening/closing apparatus includes: a support member that has a telescopic shaft shape, is interposed between a body and a door of a vehicle, and thereby is capable of holding the door at an open position, wherein the support member includes a cylindrical housing that accommodates a drive source, and a joint member that is fixed with a part thereof inserted into an end portion of the corresponding housing and is attached on the body or the door of the vehicle, and wherein the joint member has a contact portion which comes into contact with the housing when the joint member is fixed to the housing, and on which convex portions and concave portions recessed to an inner side in a radial direction with respect to the convex portions are alternately provided in a circumferential direction.

6 Claims, 6 Drawing Sheets

(56) References Cited

U.S. PATENT DOCUMENTS

| | | | | |
|---|---|---|---|---|
| 2010/0307872 | A1* | 12/2010 | Wheeler | E05C 17/30<br>188/67 |
| 2013/0119590 | A1* | 5/2013 | Anderson | F16F 9/56<br>267/124 |
| 2014/0000394 | A1* | 1/2014 | Anheier | F16H 25/20<br>74/89.29 |
| 2014/0137477 | A1* | 5/2014 | Ooe | E05F 1/1091<br>49/358 |
| 2016/0153532 | A1* | 6/2016 | Fischer | F16H 25/20<br>74/89.35 |
| 2017/0275939 | A1* | 9/2017 | Tsukagoshi | E05F 15/622 |

* cited by examiner

VEHICLE DOOR OPENING/CLOSING APPARATUS

CROSS REFERENCE TO RELATED APPLICATIONS

This application is based on and claims priority under 35 U.S.C. § 119 to Japanese Patent Application 2015-194033, filed on Sep. 30, 2015, the entire contents of which are incorporated herein by reference.

TECHNICAL FIELD

This disclosure relates to a vehicle door opening/closing apparatus.

BACKGROUND DISCUSSION

In the related art, there is known a vehicle door opening/closing apparatus that includes a telescopic support member between a body and a door of a vehicle and is capable of holding the door at an open position by the support member (for example, see Reference 1 (JP 2014-100956A)).

Such a vehicle door opening/closing apparatus is disclosed to have a configuration in which an actuator that causes the support member to extend or retract is built into the support member. The support member includes a substantially cylindrical outer housing and an inner housing having a smaller diameter than the outer housing, and extends or retracts by the actuator that causes the inner housing to move in an axial direction in the outer housing. Then, joint members are provided at both end portions of the support member in the axial direction (longitudinal direction) and the joint members are fitted into a spherical fitting portion provided in connection portions on the door side and on the body side.

Incidentally, a configuration, in which such a vehicle door opening/closing apparatus described above includes circumferential engagement portions that engage with an inner circumferential surface of the outer housing and an outer circumferential surface of the inner housing in a circumferential direction, respectively, may be considered. In this configuration, the circumferential engagement portion of the outer housing and the circumferential engagement portion of the inner housing have, for example, protrusions and grooves alternately in the circumferential direction. The protrusion of the outer housing has a shape that protrudes to the inner side in a radial direction and the protrusion of the inner housing has a shape that protrudes to the outer side in the radial direction. The protrusion of the outer housing is positioned in the groove of the inner housing in a state of being assembled to the inner housing, and the protrusion of the inner housing is positioned in the groove of the outer housing in a state of being assembled to the outer housing. In addition, the circumferential engagement portions of the outer housing and the circumferential engagement portions of the inner housing are individually formed to have a predetermined length in the axial direction, such that an engagement state is maintained in the circumferential direction even in a case where the inner housing and the outer housing relatively move with respect to each other in the axial direction.

In this configuration, when the inner housing receives a rotational force from the actuator, a circumferential force is generated between the outer housing and the inner housing. At this time, since rotation of the outer housing is regulated by the joint member of an axial end portion, the inner housing and the outer housing are caused to relatively move with respect to each other in the axial direction such that the support member extends and retracts.

However, since the housings and the joint members are fixed by caulking, there is a concern that the housings and the joint members will relatively rotate with respect to each other in the circumferential direction due to the fixing strength of the caulking between the housings and the joint members when the circumferential force is generated between the outer housing and the inner housing.

SUMMARY

Thus, a need exists for a vehicle door opening/closing apparatus which is not susceptible to the drawback mentioned above.

A vehicle door opening/closing apparatus according to an aspect of this disclosure includes: a support member that has a telescopic shaft shape, is interposed between a body and a door of a vehicle, and thereby is capable of holding the door at an open position. In the vehicle door opening/closing apparatus, the support member includes a cylindrical housing that accommodates a drive source, and a joint member that is fixed with a part thereof inserted into an end portion of the corresponding housing and is attached on the body or the door of the vehicle, and the joint member has a contact portion which comes into contact with the housing when the joint member is fixed to the housing, and on which convex portions and concave portions recessed to an inner side in a radial direction with respect to the convex portions are alternately provided in a circumferential direction.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Hereinafter, an embodiment of a vehicle door opening/closing apparatus will be described.

Figure 1:
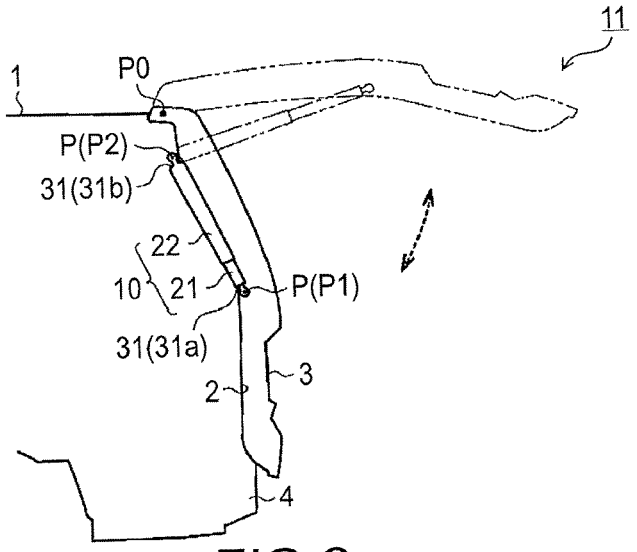
FIG. 1 is a side view of a vehicle door opening/closing apparatus according to an embodiment.

As illustrated in FIG. 1, a so-called a flip-up back door 3, which performs an opening/closing operation, is provided in a door opening 2 formed in a rear portion of a vehicle 1 with a fulcrum P0 set in an upper end portion of the door opening as a rotating center. In addition, support members 10 are provided at both ends of the door opening 2 in a width direction, have a telescopic shaft shape, and are interposed between the back door 3 and a body 4, thereby being capable of holding the back door 3 at an open position. Thus, in the embodiment, a power back door apparatus 11 is formed to cause the back door 3 to perform the opening/closing operation, with the support member 10 as an actuator.

Figure 2:
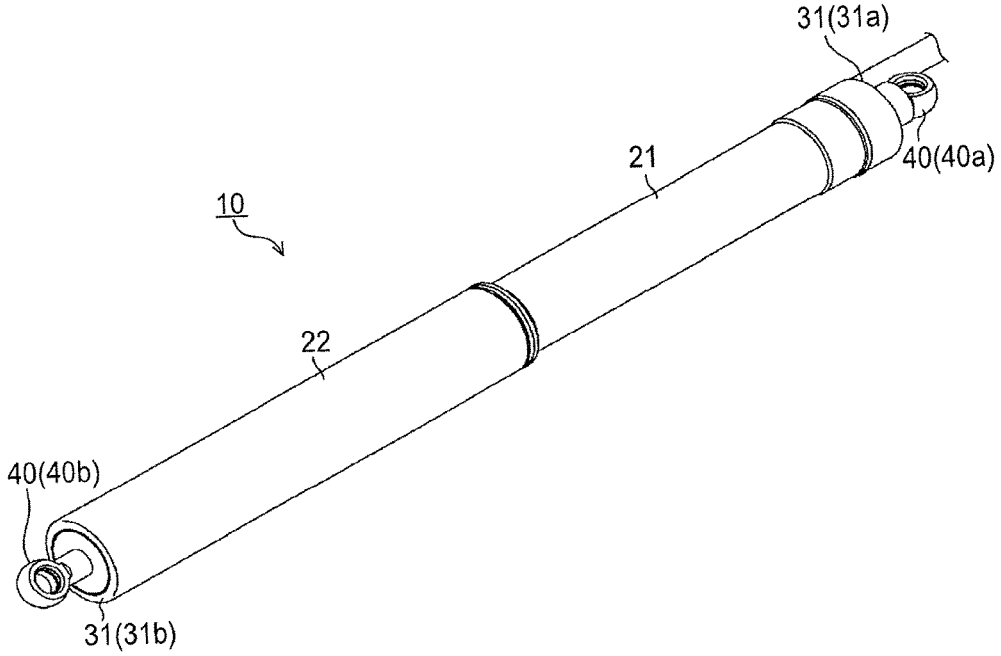
FIG. 2 is a perspective view of a support member.
Figure 3:
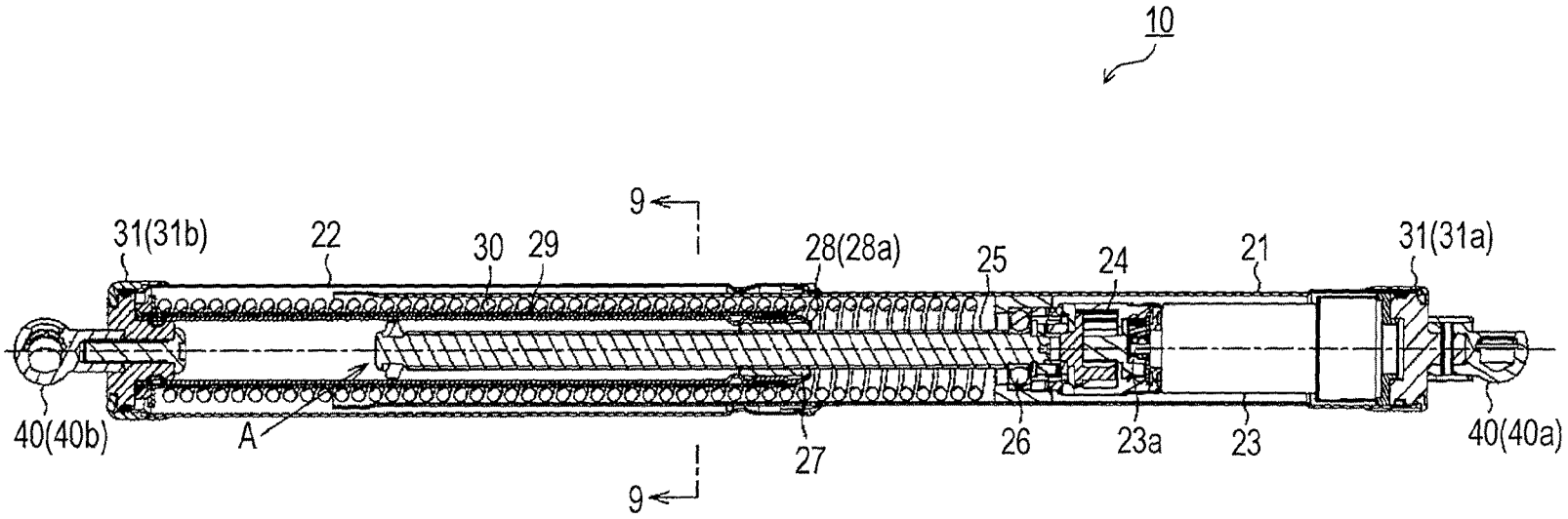
FIG. 3 is a sectional view of the support member.

To be more specific, as illustrated in FIGS. 2 and 3, the support member 10 of the embodiment includes an inner housing 21 having a substantially bottomed cylinder shape, and an outer housing 22 having a substantially bottomed cylinder shape into which the inner housing 21 is inserted. Then, the inner housing 21 and the outer housing 22 are concentrically disposed and are formed to be capable of being telescopic in an axial direction of the housings.

A motor 23 as a drive source is accommodated in the inner housing 21. A screw spindle 25 extends to be concentric to and is connected to a motor shaft 23*a* of the motor 23 via a speed reducer 24. Note that, in the embodiment, a base end portion of the screw spindle 25 is supported on a ball bearing 26. A spindle nut 27, into which the screw spindle 25 is screwed, is provided on the outer housing 22 side.

Specifically, a first guide tube 28 having a substantial cylinder shape is concentrically fixed in the cylinder of the inner housing 21. In addition, a distal end of the screw spindle 25 is inserted into the first guide tube 28. Then, the spindle nut 27 is fixed to an opening end 28*a* (end on the right side in FIG. 3) of the first guide tube 28.

In this manner, in the embodiment, a drive device A, which is capable of causing the support member 10 to extend and to retract with the motor 23 as a drive source, is built into each of the support members 10. In other words, the screw spindle 25 rotates by the drive of the motor, and thereby the spindle nut 27 screwed to the screw spindle 25 moves in the axial direction over the screw spindle 25 (a pair of screws). Thus, the inner housing 21 and the outer housing 22 relatively move in the axial direction, and thereby it is possible to change a length of the support member 10 of the embodiment in the axial direction.

To be still more specific, in the embodiment, a second guide tube 29 having a diameter larger than the first guide tube 28 is concentrically disposed in the cylinder of the outer housing 22. In addition, a compression coil spring 30 is fitted on the outer circumference of the second guide tube 29. Then, one end of the compression coil spring 30 comes into contact with a bottom of the outer housing 22, and the other end thereof comes into contact with the ball bearing 26 on the inner housing 21 side.

As illustrated in FIG. 1, in the embodiment, the support members 10 configured as described above have axial end portions 31 (31*a* and 31*b*), respectively, which are rotatably connected to the back door 3 and the body 4, respectively. Specifically, the axial end portion 31*a* on the inner housing 21 side is connected to the back door 3, and the axial end portion 31*b* on the outer housing 22 side is connected to the body 4. Then, the support members 10 extends and retracts while the support members relatively pivot with respect to the back door 3 and the body 4 around pivot connection points P (P1 and P2), and thereby it is possible to cause the back door 3 to perform the opening/closing operation.

In other words, the power back door apparatus 11 of the embodiment causes the axial length of the support member 10 to extend, based on a drive force of the motor 23 provided in each cylinder of the support members 10, and thereby the back door 3 performs the opening operation. In addition, the axial length of the support member 10 retracts, and thereby the back door 3 performs the closing operation. Then, each axial length (extended or retracted length) of the support members 10 is maintained, based on an elastic force of the compression coil spring 30 accommodated in the cylinder, and thereby it is possible to hold the back door 3 at the open position.

Figure 9:
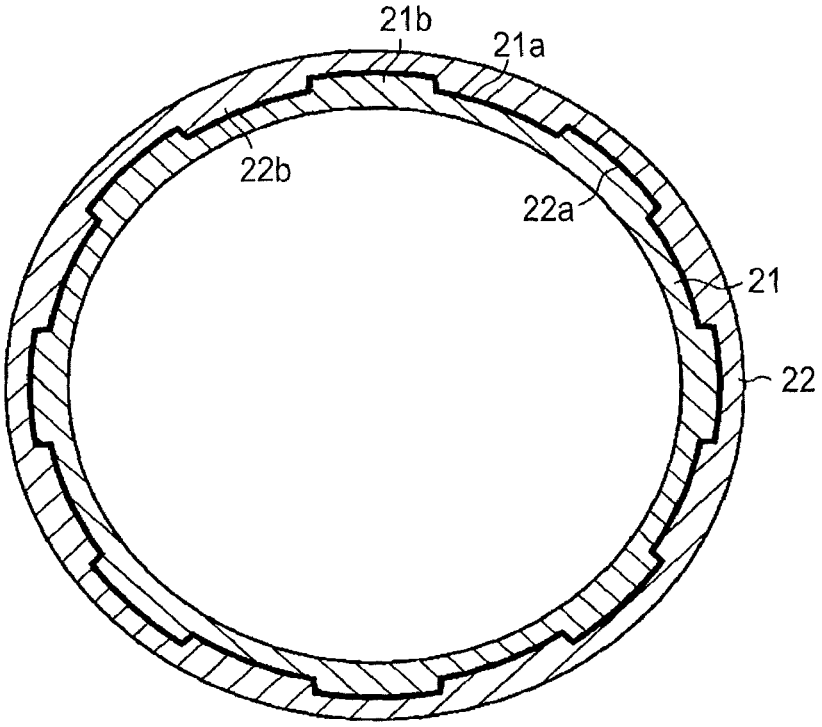
FIG. 9 is a sectional view illustrating an engagement state of an inner housing and an outer housing configuring the support member, taken along 9-9 line in FIG. 3.

As illustrated in FIG. 9, circumferential engagement portions 21*b* and 22*b*, which engage with each other in the circumferential direction in a state in which the housings 21 and 22 are assembled, are formed on an outer circumferential surface 21*a* of the inner housing 21 and an inner circumferential surface 22*a* of the outer housing 22, respectively. The circumferential engagement portion 21*b* formed on the outer circumferential surface 21*a* of the inner housing 21 has protrusions protruding to an outer side in a radial direction, which are formed in the circumferential direction at substantially equiangular intervals. The circumferential engagement portion 22*b* formed on the inner circumferential surface 22*a* of the outer housing 22 has protrusions protruding to an inner side in a radial direction, which are formed in the circumferential direction at substantially equiangular intervals. The circumferential engagement portions 22*b* are configured to have a predetermined length in the axial direction such that the inner housing 21 and the outer housing 22 are allowed to relatively move by a predetermined distance in the axial direction (inserting direction).

Figure 7:
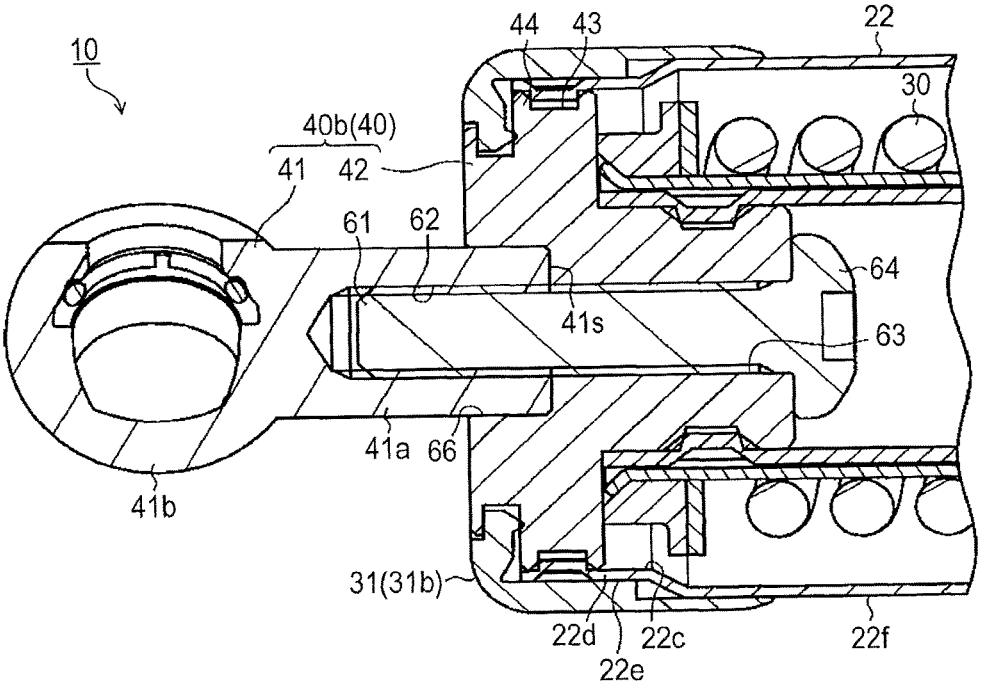
FIG. 7 is a sectional view of the other end portion of the support member.
Figure 8:
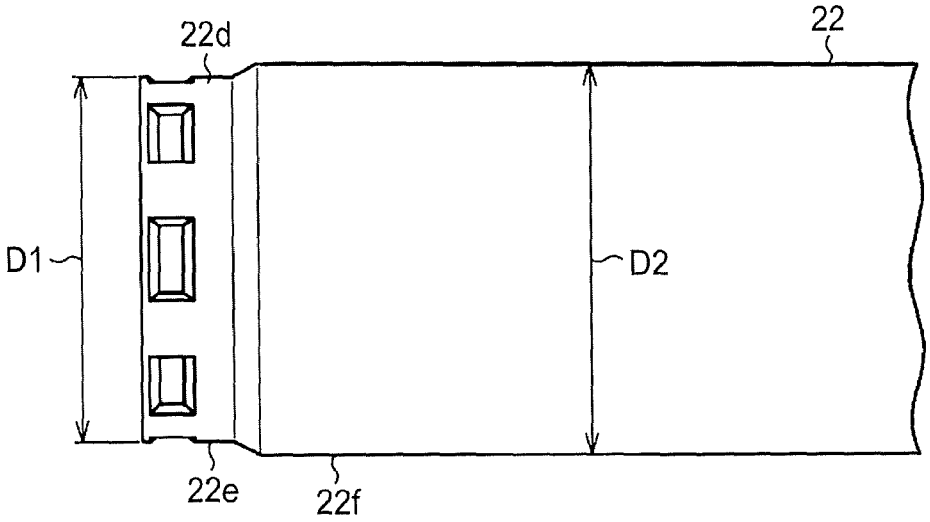
FIG. 8 is a side view illustrating a part of the support member.

In addition, as illustrated in FIGS. 7 and 8, the outer housing 22 has a cylindrical portion 22*d* whose inner circumferential surface 22*c* has a cylinder shape. The cylindrical portion 22*d* is molded by shrinkage tube molding such that a diameter (outer diameter) D1 of an outer circumferential edge portion 22*e* of the cylindrical portion 22*d* is smaller than a diameter (outer diameter) D2 of outer circumferential edge portion 22*f* as the other portion at a position shifted from the outer circumferential edge portion 22*e* in the axial direction.

As illustrated in FIGS. 1 and 2, joint members 40 (40*a* and 40*b*) are formed at the axial end portions 31 (31*a* and 31*b*) of the support members 10, and are fitted to brackets provided on the back door 3 side and on the body 4 side, respectively, thereby forming the pivot connection points P (P1 and P2) of the support members 10.

Figure 6:
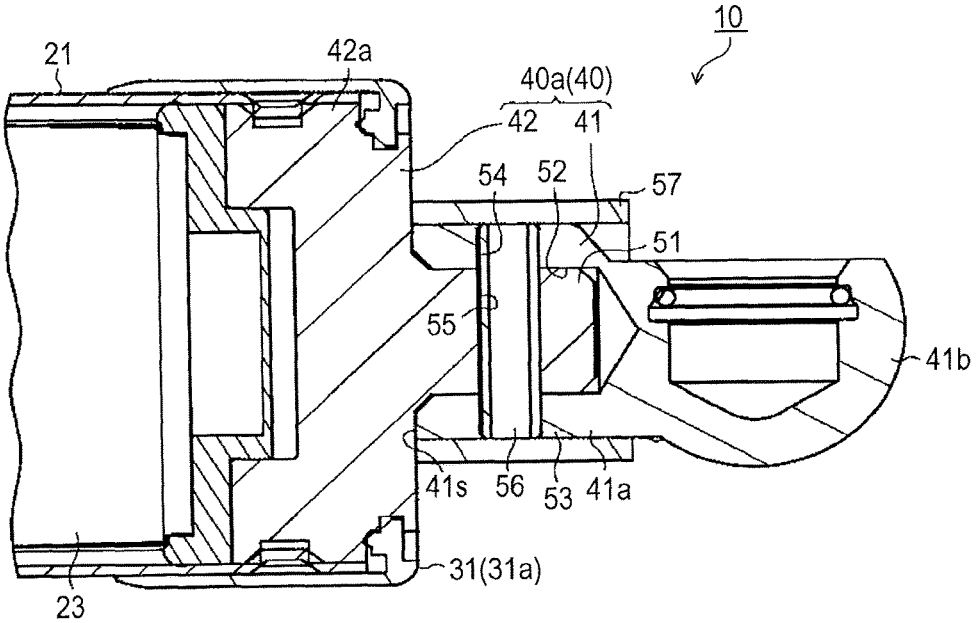
FIG. 6 is a sectional view of an end portion of the support member.

As illustrated in FIGS. 6 and 7, each of the joint members 40 (40*a* and 40*b*) on the inner housing 21 side and the outer housing 22 side has a joint main body 41 and a fixing portion 42.

The joint main bodies 41 include a substantially circular columnar shaft 41*a* and a joint portion 41*b* that is provided at a distal end of the shaft 41*a* and that is fitted to the bracket.

Figure 4:
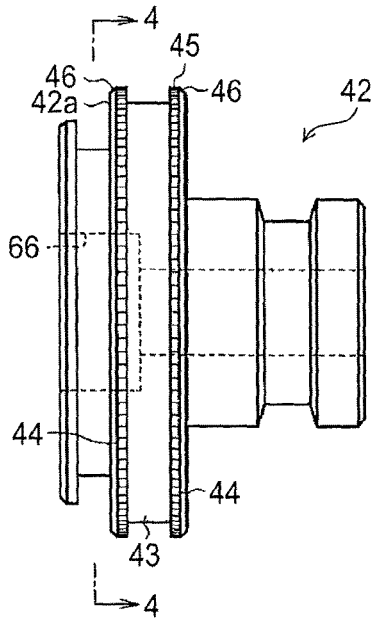
FIG. 4 is a side view of a fixing member with which a joint member is configured.
Figure 5A:
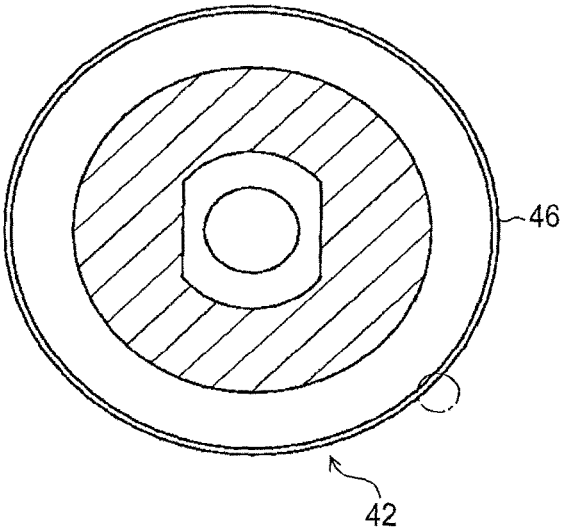
FIG. 5A is a sectional view of the fixing member taken along 4-4 line in FIG. 4.
Figure 5B:
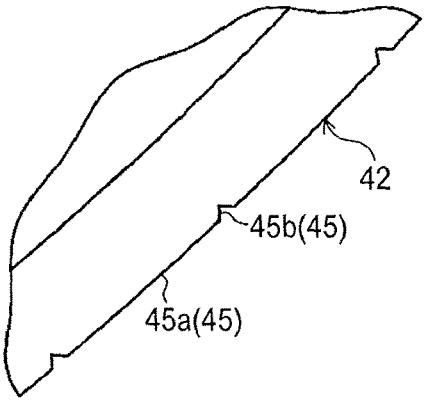
FIG. 5B is an enlarged view of a part in FIG. 5A according to an embodiment.

As illustrated in FIGS. 4 to 5B, the fixing portions 42 have a substantially disk-shaped base portion 42*a* that closes openings on the axial end portions 31 (31*a* and 31*b*) of the housings 21 and 22.

Here, the base portion 42*a* of the fixing portion 42 that is fixed to the outer housing 22 is described. Note that the base portion 42*a* of the fixing portion 42 that is fixed to the inner housing 21 may also have the same configuration as that.

As illustrated in FIG. 4, the base portions 42*a* have a columnar portion 43 and flanges 44 formed at both ends of the columnar portion 43 in the axial direction. Here, a part of the housings 21 and 22 is subjected to caulking and to plastic deformation between the flanges 44 in the axial direction such that the flanges 44 and a part of the housings 21 and 22 engage with each other in the axial direction. Thus, the joint members 40 are prevented from escaping.

Figure 5C:
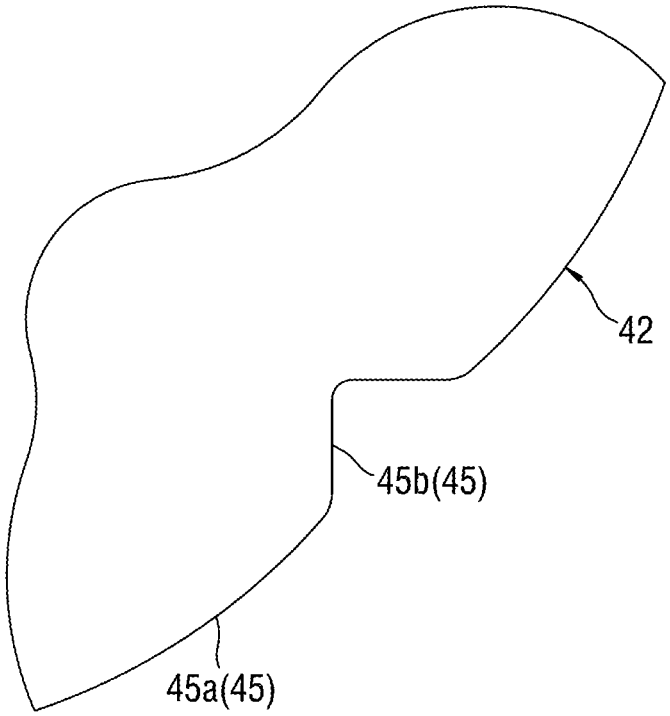
FIG. 5C is an enlarged view of apart in FIG. 5A according to an embodiment.

As illustrated in FIGS. 4 to 5C, a straight knurling portion 45 formed of a convex portion 45*a* and a concave portion

45*b* is formed on an outer circumferential surface of the flange 44. At this time, a part of the housings 21 and 22 as described above is fixed by the caulking to the fixing portions 42 of the joint members 40 (40*a* and 40*b*), then, a part of the housings enters the concave portion 45*b*, and an engagement force between the housings 21 and 22 and the joint members 40 (40*a* and 40*b*) (fixing portion 42) is generated in the circumferential direction. As a result, relative rotation between the housings 21 and 22 and the joint members 40 (40*a* and 40*b*) is reduced. Incidentally, as illustrated in FIGS. 5B and 5C, the convex portion 45*a* is formed to have a surface area larger than a surface area of the concave portion 45*b*.

In addition, an edge portion 46 of the flange 44 is subjected to chamfering, and thus the edge portion 46 less interferes with the insertion of the joint members when the joint members are inserted in the housings 21 and 22.

As illustrated in FIG. 6, the fixing portion 42, which is provided in the axial end portion 31*a* on the inner housing 21 side, has a projection-fitting portion 51 having a substantially circular column shape, which is formed to project from the base portion 42*a* in the axial direction. The projection-fitting portion 51 is to be inserted into a fitting hole 52 formed in the shaft 41*a* of a joint member 40*a*. The fitting hole 52 is drilled along an axial line (a direction toward the right side in FIG. 6) of the shaft 41*a* from a shaft end surface 41*s* of the shaft 41*a*. In addition, a penetration hole 54 is formed in the shaft 41*a* of the joint member 40*a* in which the fitting hole 52 is formed, and the penetration hole penetrates through the shaft 41*a* in a direction (vertical direction in FIG. 6) intersecting with the axial line of the shaft and, for details, penetrates through a wall 53 of the fitting hole 52. Further, a through-hole 55 is also formed in the projection-fitting portion 51 on the axial end portion 31*a* side, which is inserted in the fitting hole 52, and the through-hole penetrates through the corresponding projection-fitting portion 51 in the direction (vertical direction in FIG. 6) intersecting with the axial direction at a position corresponding to the through-hole 54 formed in the shaft 41*a*. Then, a fixing pin 56 as a fixing member is inserted in the through-holes 54 and 55 and the fixing pin is disposed across a wall of the fitting hole 52 and the projection-fitting portion 51 so as to fix the projection-fitting portion 51 into the fitting hole 52.

Note that, in the embodiment, an inner diameter of the fitting hole 52 is set to be substantially equal to a diameter of the projection-fitting portion 51. In addition, the axial length of the fixing pin 56 is set to be substantially equal to a diameter of the shaft 41*a*. Then, a cover 57 is attached to the joint member 40*a* and surrounds an outer circumference of the shaft 41*a*, thereby holding the fixing pin 56 in the through-holes 54 and 55.

As illustrated in FIG. 7, the fixing portion 42, which is provided in the axial end portion 31*b* on the outer housing 22 side, has a screw shaft 61 which is formed to project from the base portion 42*a* in the axial direction. A screw hole 62, into which the screw shaft 61 is screwed, is formed in the joint member 40*b* that is attached to the axial end portion 31*b*.

Specifically, the screw hole 62 on the joint member 40*b* side is provided along an axial line (a direction toward the left side in FIG. 7) of a shaft 41*a* from a shaft end surface 41*s* of the shaft 41*a*. In addition, the screw shaft 61 on the axial end portion 31*b* is formed to be screwed through the screw hole 63 formed in the fixing portion 42 on the outer housing 22 and a bolt 64 is screwed form the inner side (right side in FIG. 7) of the cylinder so as to penetrate the fixing portion 42. In other words, the bolt 64, with which the screw shaft 61 is configured, is screwed into the screw hole 62 of the joint member 40*b* via the screw hole 63. Thus, the joint member 40*b* is fastened to the axial end portion 31*b* of the support member 10 in a state in which the shaft 41*a* projects from the bottom of the outer housing 22.

Note that, in the embodiment, a recessed portion 66 is formed in the fixing portion 42 (base portion 42*a*) of the outer housing 22 side and the vicinity of the shaft end surface 41*s* of the shaft 41*a* on the joint member 40*b* side is inserted into the recessed portion 66. Then, a rotation stopping structure (so-called dihedral-width fitting structure) that regulates the rotation of the shaft 41*a* inserted into the recessed portion 66.

Hereinafter, according to the embodiment, it is possible to achieve the following effects.

(1) Since the joint members 40 (40*a* and 40*b*) have contact portions which come into contact with the housings 21 and 22 when the joint members are fixed to the housings, and on which the convex portions 45*a* and the concave portions 45*b* recessed to the inner side in the radial direction with respect to the convex portions 45*a* are alternately provided in the circumferential direction, it is expected that the engagement will be performed such that a part of the housings 21 and 22 enters the concave portions 45*b* when the housings 21 and 22 and the joint members 40 (40*a* and 40*b*) are fixed by caulking. As a result, a fixing strength is increased by the caulking, and thus it is possible to reliably prevent the housings 21 and 22 and the joint members 40 (40*a* and 40*b*) from rotating.

(2) The convex portion 45*a* has the surface area larger than the concave portion 45*b*, and the joint members are likely to be positioned in the housings 21 and 22 mainly by the convex portion 45*a* positioned on the outer side from the concave portion 45*b*, when the joint members come into contact with the housings 21 and 22, such that it is possible to reduce an axial shift of the joint members 40 (40*a* and 40*b*).

(3) The edge portion 46 is chamfered, and thus it is possible for the joint members 40 (40*a* and 40*b*) to be easily inserted, when the joint members 40 (40*a* and 40*b*) are inserted into the housings 21 and 22.

(4) It is possible for the convex portions 45*a* and the concave portions 45*b* to be formed by the straight knurling by which it is relatively easy to produce the convex and concave portions.

(5) Since the outer housing 22 has the inner circumferential surface 22*c* having has the cylinder shape, on the end side to which the joint member 40*b* is fixed, it is possible to fix (for example, caulk) the joint member 40*b* and the outer housing 22 regardless of positions of the joint member 40*b* and the outer housing 22 in the rotating direction (circumferential direction). Here, the joint members 40 (40*a* and 40*b*) provided at both the ends of the support member 10 are provided at different positions in the circumferential direction with respect to the housings 21 and 22 due to a difference in types of vehicles to which the vehicle door opening/closing apparatus is attached. Therefore, there is a need to relatively position, in the circumferential direction (rotating direction), the joint member 40*a* that is fixed to the inner housing 21 side, and the joint member 40*b* that is fixed to the outer housing 22 side. The inner housing 21 and the outer housing 22 are provided with the circumferential engagement portions 21*b* and 22*b*, respectively, and the circumferential engagement portions 21*b* and 22*b* regulate a rotating position. Therefore, there is a need to set a fixing position (caulking position) of the joint members 40 (40*a* and 40*b*) and the housings 21 and 22 in consideration of the positions of the circumferential engagement portions 21*b* and 22*b*. However, as described above, since the inner circumferential surface 22*c* of the end portion of the outer housing 22 has the cylinder shape, it is possible to adjust the fixing position of the outer housing 22 and the joint member 40*b*. As a result, there is no need to consider the positions of the circumferential engagement portions 21*b* and 22*b* even when the inner housing 21 and the joint member 40*a* are fixed to each other.

(6) Since the outer housing 22 has the diameter D1 of the cylindrical portion 22*d* on the outer circumferential edge portion 22*e* (outer circumferential surface) which is smaller than the diameter D2 of the other portion of the outer housing 22 on the outer circumferential edge portion 22*f* (outer circumferential surface), it is possible to have a thin end portion as the support member 10. Accordingly, it is possible to attach the support member 10 without interference with the back door 3, the body 4, or the like. In addition, the cylindrical portion 22*d* is molded by shrinkage tube molding such that it is possible to increase accuracy of the dimension.

Note that the embodiment described above may be modified as follows.

In the embodiment described above, the straight knurling portion 45 is provided on the flange 44 positioned in the vicinity of the caulking portion; however, the knurling is not limited to the straight knurling, and, for example, the reticulated knurling may be employed.

In the embodiment described above, the straight knurling portion 45 is configured of the concave portions 45*b* and the convex portions 45*a* and the convex portion 45*a* has a larger surface area; however, the straight knurling portion 45 may be configured of the concave portions 45*b* that has the same surface area as the convex portions 45*a* or the concave portion 45*b* has a larger surface area than the convex portion 45*a*.

In the embodiment described above, the outer housing 22 has the diameter of the cylindrical portion on the axial end portion 31*b* on the outer circumferential surface which smaller than the diameter of the portion, in which the circumferential engagement portion is formed by the shrinkage tube molding, on the outer circumferential surface; however the disclosure is not limited thereto.

In the embodiment described above, the support members 10 are provided at both ends of the door opening 2 in the width direction; however, one or three or more the support members 10 may be provided.

In the embodiment described above, the power back door apparatus 11 that causes the back door 3 of the vehicle 1 to perform the opening or closing operation is embodied; however, another vehicle door opening/closing apparatus may be embodied.

The embodiment described above and the modification examples may be appropriately combined.

A vehicle door opening/closing apparatus according to an aspect of this disclosure includes: a support member that has a telescopic shaft shape, is interposed between a body and a door of a vehicle, and thereby is capable of holding the door at an open position. In the vehicle door opening/closing apparatus, the support member includes a cylindrical housing that accommodates a drive source, and a joint member that is fixed with a part thereof inserted into an end portion of the corresponding housing and is attached on the body or the door of the vehicle, and the joint member has a contact portion which comes into contact with the housing when the joint member is fixed to the housing, and on which convex portions and concave portions recessed to an inner side in a radial direction with respect to the convex portions are alternately provided in a circumferential direction.

According to this configuration, since the joint member has a contact portion which comes into contact with the housing when the joint member is fixed to the housing, and on which convex portions and concave portions recessed to the inner side in the radial direction with respect to the convex portions are alternately provided in the circumferential direction, it can be assumed expected that the engagement will be performed such that a part of the housing enters the concave portions when the housing and the joint member are fixed by caulking. As a result, a fixing strength is increased by the caulking, and thus it is possible to reliably prevent the housing and the joint member from rotating.

In the vehicle door opening/closing apparatus, it is preferable that the convex portion has a surface area larger than the concave portion.

According to this configuration, the convex portion has a surface area larger than the concave portion, and the joint member is likely to be positioned in the housing mainly due to the convex portion positioned on the outer side from the concave portion, when the joint member comes into contact with the housing, such that it is possible to reduce an axial shift of the joint member.

In the vehicle door opening/closing apparatus, it is preferable that, in the joint member, edge portions of the convex portion and the concave portion in an inserting direction have a chamfered shape.

According to this configuration, the edge portions are chamfered, and thus it is possible for the joint member to be easily inserted when the joint member is inserted into the housing.

In the vehicle door opening/closing apparatus, it is preferable that the concave portions and the convex portions are formed by straight knurling and are provided in the circumferential direction of the joint member at equiangular intervals.

According to this configuration, it is possible for the convex portions and the concave portions to be formed by straight knurling by which it is relatively easy to produce the convex and concave portions.

In the vehicle door opening/closing apparatus, it is preferable that the housing includes a cylindrical first housing and a cylindrical second housing that is inserted into the first housing and has a diameter smaller than the first housing, the first housing and the second housing have circumferential engagement portions, respectively, which engage with each other in the circumferential direction and allow the housings to relatively move with respect to each other in the inserting direction as an axial direction, and the first housing has the circumferential engagement portion on one end side thereof and a cylindrical portion, at least an inner circumferential surface of which has a cylindrical shape, on the other end side to which the joint member is fixed.

According to this configuration, since the inner circumferential surface on the one end side, to which the joint member is fixed, is formed of the cylindrical portion, it is possible to fix (for example, caulk) the joint member and the first housing regardless of positions of the joint member and the first housing in the rotating direction (circumferential direction). Here, the joint members provided at both of the ends of the support member are provided at different positions in the circumferential direction with respect to the housing due to differences in type of vehicle to which the vehicle door opening/closing apparatus is attached. Therefore, there is a need to relatively position, in the circumferential direction (rotating direction), the joint member that is fixed to the second housing side, and the joint member that is fixed to the first housing side. The first housing and the second housing are provided with the circumferential engagement portions, respectively, and the circumferential engagement portions regulate a rotating position. Therefore, there is a need to set a fixing position (caulking position) of the joint members and the housings in consideration of the positions of the circumferential engagement portions. However, as described above, since the inner circumferential surface of the end portion (the other portion) of the first housing has the cylinder shape, it is possible to adjust the fixing position of the first housing and the joint member. As a result, there is no need to consider the positions of the circumferential engagement portions even when the second housing and the joint member are fixed to each other.

In the vehicle door opening/closing apparatus, it is preferable that, in the first housing, a diameter of the cylindrical portion on an outer circumferential surface is smaller than a diameter of the other portion of the first housing on an outer circumferential surface.

According to this configuration, since the first housing has the diameter of the cylindrical portion on an outer circumferential surface which is smaller than the diameter of the other portion of the first housing on an outer circumferential surface, it is possible to have a thin end portion as the support member.

According to a vehicle door opening/closing apparatus of the aspect of this disclosure, it is possible to reliably prevent a housing and a joint member of a support member from rotating.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

What is claimed is:

1. A vehicle door opening and closing apparatus comprising:

a support member that has a telescopic shaft, is interposed between a body and a door of a vehicle, and thereby is capable of holding the door at an open position, wherein the support member includes a cylindrical housing that accommodates a drive source, and a joint member that is fixed with a part thereof inserted into an end portion of the cylindrical housing and is attached on the body or the door of the vehicle, and wherein the joint member has a contact portion which projects into an interior of the housing and is fixed to the housing by caulking when the joint member is fixed to the housing, and wherein the contact portion includes convex portions and concave portions recessed in a radial direction of the contact portion with respect to the convex portions, the convex and concave portions are alternately provided in a circumferential direction of the contact portion and are fixed to the housing by the caulking.

2. The vehicle door opening and closing apparatus according to claim 1, wherein the convex portion has a surface area larger than the concave portion.

3. The vehicle door opening and closing apparatus according to claim 1, wherein, in the joint member, edge portions of the convex portion and the concave portion have a chamfered shape.

4. The vehicle door opening and closing apparatus according to claim 1, wherein the concave portions and the convex portions include straight knurling on the circumferential direction of the joint member at equiangular intervals.

5. The vehicle door opening and closing apparatus according to claim 1, wherein the cylindrical housing includes a first cylindrical housing and a second cylindrical housing, the second cylindrical housing is configured to be inserted into the first cylindrical housing and has a diameter smaller than the first cylindrical housing, wherein the first cylindrical housing and the second cylindrical housing have circumferential engagement portions, respectively, which engage with each other in the circumferential direction and allow the first and second cylindrical housings to relatively move with respect to each other in an axial direction, and wherein the first cylindrical housing has the circumferential engagement portion on a first end side thereof and a cylindrical portion, at least an inner circumferential surface of which has a cylindrical shape, and the joint member is fixed to a second end side of the first cylindrical housing.

6. The vehicle door opening and closing apparatus according to claim 5, wherein, in the first cylindrical housing, a diameter of the cylindrical portion on an outer circumferential surface is smaller than a diameter of another portion of the first cylindrical housing on an outer circumferential surface.

* * * * *